US007967639B1

(12) United States Patent
Huang et al.

(10) Patent No.: US 7,967,639 B1
(45) Date of Patent: Jun. 28, 2011

(54) BATTERY CONNECTOR

(75) Inventors: Sheng-Yuan Huang, Tu Cheng (TW); Chung-Yu Chen, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 19 days.

(21) Appl. No.: 12/630,835

(22) Filed: Dec. 3, 2009

(51) Int. Cl.
*H01R 13/648* (2006.01)

(52) U.S. Cl. ..... 439/607.35; 439/862

(58) Field of Classification Search .. 439/607.35–607.4, 439/862
See application file for complete search history.

(56) References Cited

U.S. PATENT DOCUMENTS 5,030,140 A * 7/1991 Sugiyama ..... 439/607.35
5,622,522 A * 4/1997 Tan et al. ..... 439/607.28
6,056,560 A * 5/2000 Wu et al. ..... 439/108
6,402,554 B1 * 6/2002 Yeh ..... 439/607.39
6,478,623 B1 * 11/2002 Wu ..... 439/607.35
6,918,799 B2 * 7/2005 Zhu et al. ..... 439/862
6,939,172 B2 * 9/2005 Lu ..... 439/607.2
7,029,308 B2 * 4/2006 Wada ..... 439/330
7,077,664 B1 * 7/2006 Wang et al. ..... 439/70
7,435,139 B2 * 10/2008 Yang ..... 439/607.01
7,445,502 B2 * 11/2008 Zhang ..... 439/607.01
7,883,370 C1 * 2/2011 Ting et al. ..... 439/607.35

* cited by examiner

*Primary Examiner* — Neil Abrams
(74) *Attorney, Agent, or Firm* — Cheng-Ju Chiang

(57) ABSTRACT

A connector has an insulating housing defining a plurality of terminal receiving cavities each extending vertically to pass therethrough, a plurality of conductive terminals received in the terminal receiving cavities and a shell mounted to the insulating housing. A rear surface of the insulating housing is protruded outward to from a projection defining an inserting groove passing therethrough. The shell has a base board, a holding board facing the base board and a pair of sideboards connecting the base board and the holding board. Top edges of the base board and the holding board are extended towards each other to form eave portions. An inserting portion is extended from a portion of the base board. The shell encircles the insulating housing with the eave portions covering tops of two opposed sides of the insulating housing and the inserting portion being inserted into the inserting groove and further connected to ground.

10 Claims, 4 Drawing Sheets

BATTERY CONNECTOR

BACKGROUND OF THE INVENTION

1. Field of the Invention

The present invention generally relates to an electrical connector, and more particularly to a battery connector.

2. The Related Art

A conventional battery connector for contacting a battery includes an insulating housing and a plurality of conductive terminals disposed in the insulating housing. Each of the conductive terminals has a contact portion exposed out of the insulating housing for contacting the battery and a soldering portion exposed out of the insulating housing to be soldered with a printed circuit board. At present, the battery connector mainly transmits low frequency signals or low speed signals.

However, with the development of electronic field, the battery connector is required to transmit some high-frequency signals or high-speed signals. As a result, some electromagnetic interference signals are inevitably generated. The above-mentioned battery connector has no function of shielding electromagnetic interference. Therefore, the electromagnetic interference signals generated by the high-frequency signals or high-speed signals may affect the signal transmission between the conductive terminals and the battery.

SUMMARY OF THE INVENTION

An object of the present invention is to provide a connector for contacting a battery. The connector has an insulating housing, a plurality of conductive terminals disposed in the insulating housing and a shell mounted to the insulating housing. The insulating housing defines a plurality of terminal receiving cavities each extending longitudinally and vertically to pass through a top surface and a bottom surface thereof. A rear surface of the insulating housing is protruded outward to from a projection at a lower portion thereof. The projection defines an inserting groove vertically passing therethrough. The conductive terminals are received in the respective terminal receiving cavities of the insulating housing and with part thereof exposed from the top surface of the insulating housing for contacting the battery. The shell has a base board, a holding board opposite to the base board and a pair of sideboards connecting the base board and the holding board. Top edges of the base board and the holding board are extended towards each other to form eave portions spaced away from each other, respectively. An inserting portion is extended downward from a portion of the base board. The shell encircles the insulating housing with the eave portions covering tops of two opposed sides of the insulating housing and the inserting portion being inserted into the inserting groove of the insulating housing and further connected to ground.

As described above, the battery connector of the present invention is so designed that the electromagnetic interference signals generated between the conductive terminals and the battery can be completely dispersed out by means of the shell encircling the insulating housing with the eave portions covering tops of two opposed sides of the insulating housing and the inserting portions being inserted into the inserting grooves and further connected to ground. Therefore, it makes the signal transmission between the conductive terminals and the battery steady.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
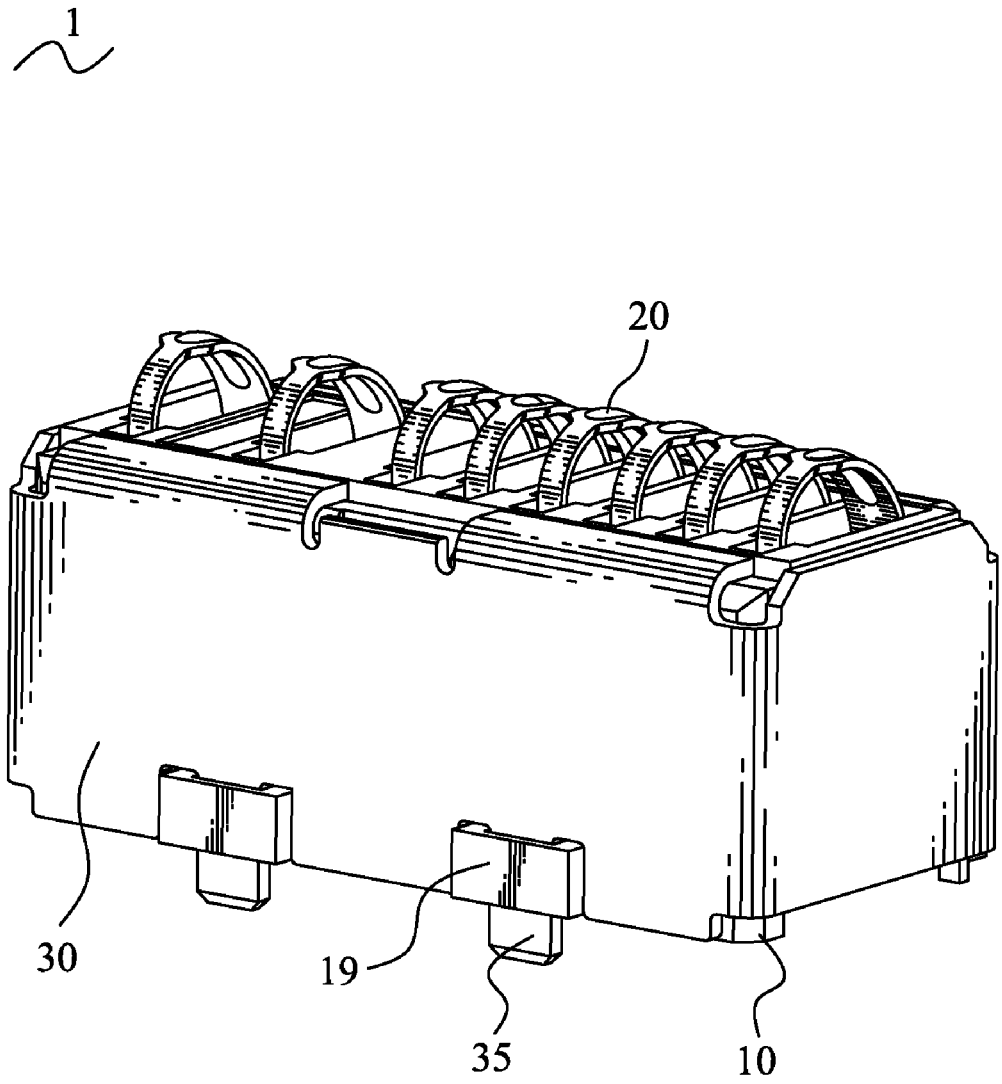
FIG. 1 is a perspective view of a battery connector in accordance with the present invention.
Figure 2:
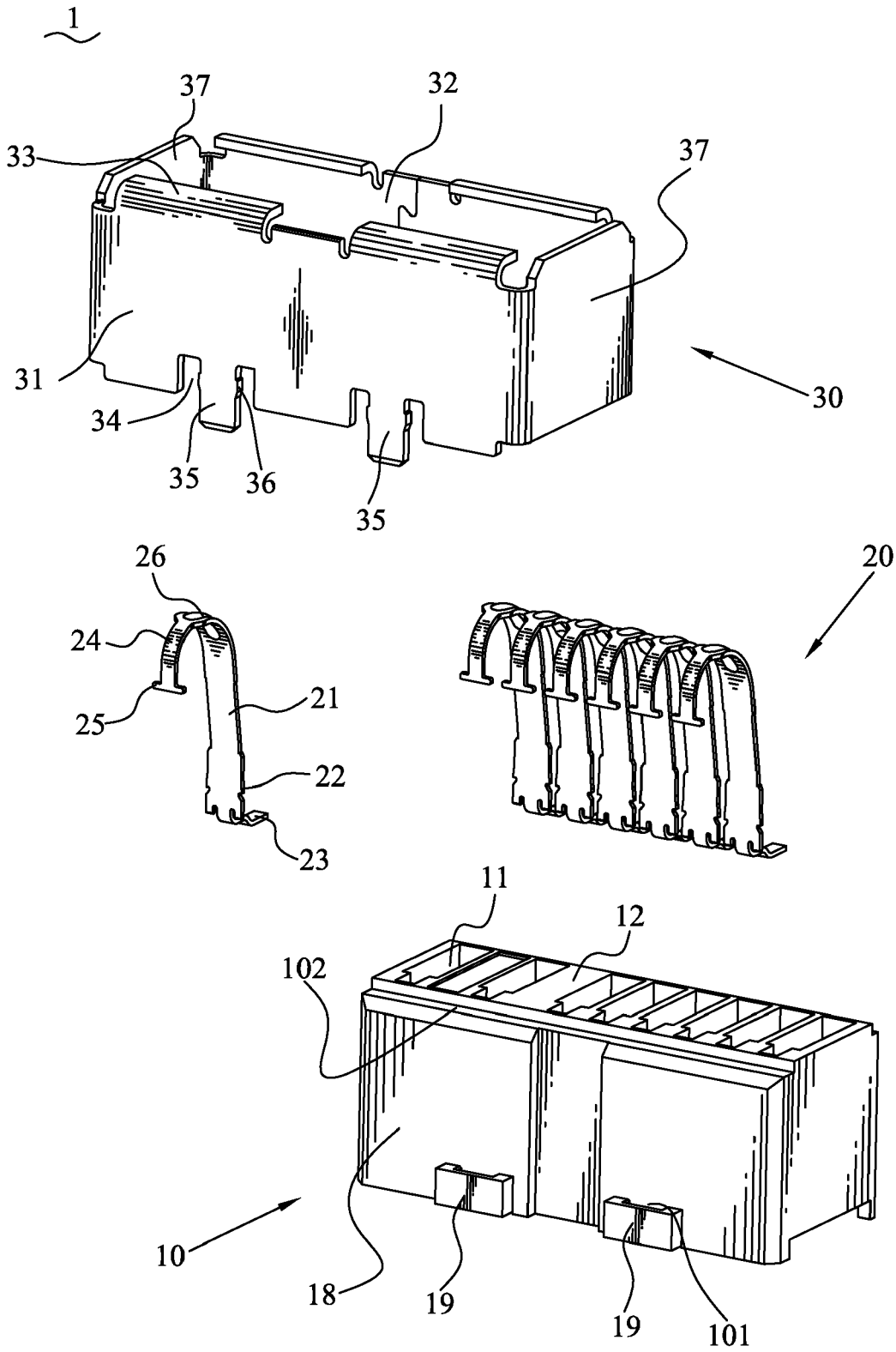
FIG. 2 is an exploded view of the battery connector of FIG. 1.

Referring to FIG. 1 and FIG. 2, a battery connector 1 in accordance with the present invention is shown. The battery connector 1 includes an insulating housing 10, a plurality of conductive terminals 20 disposed in the insulating housing 10 and a shell 30 mounted to the insulating housing 10.

Figure 3:
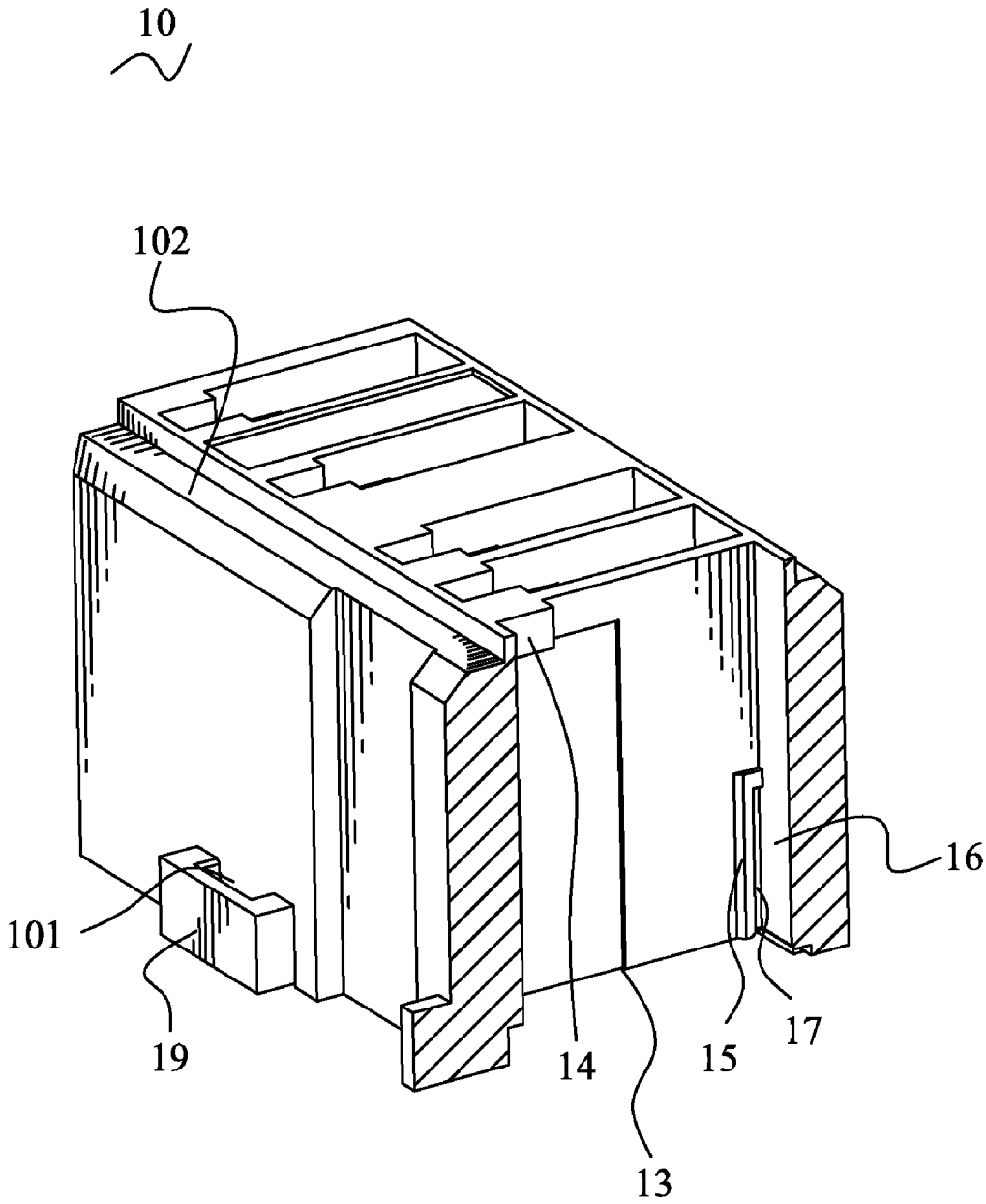
FIG. 3 is a sectional view of an insulating housing of the battery connector of FIG. 1.
Figure 4:
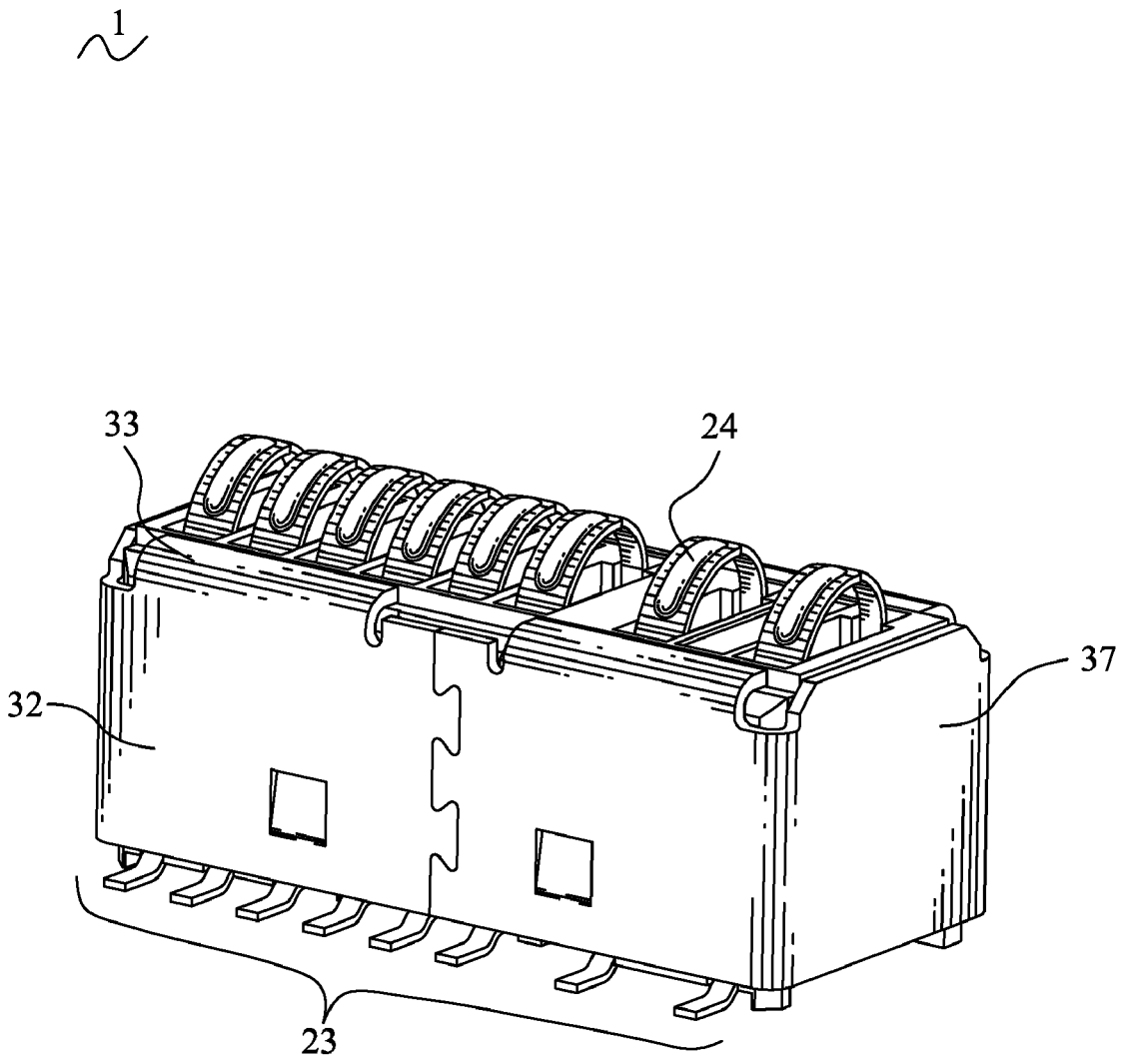
FIG. 4 is another perspective view of the battery connector of FIG. 1.

Referring to FIGS. 1-3, the insulating housing 10 is of substantial rectangular shape. The insulating housing 10 defines a plurality of rectangular terminal receiving cavities 11 arranged at regular intervals along a transverse direction. Each of the terminal receiving cavities 11 extends longitudinally and vertically to pass through a top surface 12 and a bottom surface 13 of the insulating housing 10 from up to down. Rear portions of tops of two opposite sides of the terminal receiving cavity 11 protrude face-to-face to form a pair of positioning portions 14 spaced from each other. The two opposite sides of the terminal receiving cavity 11 further protrude face-to-face to form a pair of locating portions 15 each extending vertically to a bottom edge of the terminal receiving cavity 11 at a bottom rear of the terminal receiving cavity 11. A top end of each of the locating portions 15 extends rearward to connect with a rear wall 16 of the terminal receiving cavity 11. Accordingly, a locating groove 17 is formed between the locating portion 15 and the rear wall 16 to communicate with the terminal receiving cavity 11. A lower portion of a front surface 18 of the insulating housing 10 is protruded outward to form a pair of substantial rectangular projections 19 spaced from and aligned with each other in a transverse direction. Each of the projections 19 further extends to the bottom surface 13 of the insulating housing 10. The projection 19 defines a rectangular inserting groove 101 passing therethrough from up to down. Two opposed sides of the top surface 12 of the insulating housing 10 are recessed downward to form two fixing grooves 102 extending transversely.

Referring to FIGS. 1-2, each of the conductive terminals 20 has a substantial rectangular base portion 21 disposed vertically. Two opposite side edges of the base portion 21 oppositely protrude outward to form a pair of fixing portions 22 at a lower portion of the base portion 21. A bottom of the base portion 21 is bent rearward to form a soldering portion 23. A free end of the base portion 21 extends upward and is bent forward to form a contact portion 24 of inverse-U shape. The contact portion 24 and the soldering portion 23 are located at two opposite sides of the base portion 21. A tip end of the contact portion 24 perpendicularly connects with a middle portion of a bearing portion 25 extending transversely. A holding rib 26 is formed to span an outer surface of the contact portion 24 along an extending direction of the contact portion 24.

Referring to FIGS. 1-2, the shell 30 may be a square metallic frame. In this embodiment, the shell 30 is formed by means of bending a metallic plate. Both ends of the plate are provided with a dovetailed piece (not shown) and a dovetailed groove (not shown) that fit with each other. The shell 30 has a base board 31, a holding board 32 opposite to the base board 31 and a pair of sideboards 37 paralleling to each other and connecting the base board 31 and the holding board 32 respectively. Two opposite top edges of the base board 31 and the holding board 32 of the shell 30 are protruded face-to-face to form two pairs of eave portions 33 spaced from each other, respectively. A substantial middle of a bottom edge of the base board 31 of the shell 30 is recessed upward to form a pair of gaps 34 spaced from each other. A middle of a top edge of the gap 34 extends downward to form an inserting portion 35 exposed out of the bottom edge of the base board 31. A pair of barbs 36 is protruded from two opposite side edges of each of the inserting portions 35.

Referring to FIGS. 1-4, in assembly, the conductive terminals 20 are disposed in the respective terminal receiving cavities 11 of the insulating housing 10. The base portion 21 of each of the conductive terminals 20 is disposed in the corresponding terminal receiving cavity 11 of the insulating housing 10. The two fixing portions 22 are fixed in the corresponding locating grooves 17 of the insulating housing 10. The contact portion 24 stretches out of the top surface 12 of the insulating housing 10 for contacting a corresponding battery (not shown). Two opposite ends of the bearing portion 25 are restrained under the corresponding positioning portions 14 for further preventing the contact portion 24 from flipping upwardly out of the insulating housing 10. The conductive terminal 20 can bear a relatively great external force by means of the holding rib 26 on the contact portion 24. The soldering portion 23 is exposed from a bottom of the insulating housing 10 for being soldered with a printed circuit board (not shown). The shell 30 is mounted to the insulating housing 10 with the inserting portions 35 being inserted into the corresponding inserting grooves 101 of the insulating housing 10 and further connected to ground, the projections 19 being positioned in the corresponding gaps 34, side edges of the gaps 34 further abutting against the projections 19 and the eave portions 33 being fixed in the corresponding fixing grooves 102 of the insulating housing 10 so that make the insulating housing 10 encircled by the base board 31, the holding board 32, the two sideboards 37 and the eave portions 33 of the shell 30. The barbs 36 of the shell 30 are restricted in the corresponding inserting grooves 101 for holding the inserting portions 35 in the corresponding inserting grooves 101 of the insulating housing 10 firmly. Therefore, the electromagnetic interference signals generated between the conductive terminals 20 and the battery can be completely dispersed out by means of the shell 30 encircling the insulating housing 10 with the inserting portions 35 being inserted into the inserting grooves 101 and further connected to ground.

As describe above, the battery connector 1 of the present invention is so designed that the electromagnetic interference signals generated between the conductive terminals 20 and the battery can be completely dispersed out by means of the shell 30 encircling the insulating housing 10 with the eave portions 33 covering tops of two opposite sides of the insulating housing 10 and the inserting portions 35 being inserted into the inserting grooves 101 and further connected to ground. Therefore, it makes the signal transmission between the conductive terminals 20 and the battery steady.

The forgoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A connector for contacting a battery, comprising:

an insulating housing defining a plurality of terminal receiving cavities passing through a top surface and a bottom surface thereof, a rear surface of the insulating housing being protruded outward to from a projection at a lower portion thereof, the projection defining an inserting groove vertically passing therethrough;

a plurality of conductive terminals received in the respective terminal receiving cavities of the insulating housing and with part thereof exposed from the top surface of the insulating housing for contacting the battery; and a shell mounted to the insulating housing, the shell having a base board, a holding board opposite to the base board and a pair of sideboards connecting the base board and the holding board, top edges of the base board and the holding board extended towards each other to form eave portions spaced away from each other, respectively, an inserting portion being extended downward from a portion of the base board, wherein the shell encircles the insulating housing with the eave portions covering tops of two opposed sides of the insulating housing and the inserting portion being inserted into the inserting groove of the insulating housing and further connected to ground.

2. The connector as claimed in claim 1, wherein a portion of a bottom edge of the base board is recessed upward to form a gap, the inserting portion is extended from a top edge of the gap, the inserting portion is inserted into the inserting groove with the projection being positioned in the gap and abutting against two side edges of the gap.

3. The connector as claimed in claim 1, wherein two opposed sides of the top surface of the insulating housing are recessed downward to form two fixing grooves for engaging the eaves of the shell therein.

4. The connector as claimed in claim 1, wherein two opposite side edges of the inserting portion form a pair of barbs.

5. The connector as claimed in claim 1, wherein each of the conductive terminals has a base portion disposed vertically, two opposite ends of the base portion extend oppositely to form a soldering portion and a contact portion, the base portion is received in the terminal receiving cavity, the soldering portion is exposed from a bottom of the insulating housing and the contact portion stretches out of a top of the insulating housing for contacting the battery.

6. The connector as claimed in claim 5, wherein the contact portion is of an inverse-U shape.

7. The connector as claimed in claim 6, wherein a holding rib is formed to span an outer surface of the contact portion along an extending direction of the contact portion for strengthening the contact portion.

8. The connector as claimed in claim 6, wherein two opposite sides of the terminal receiving cavity protrude face-to-face to form a pair of positioning portions at a top portion of the terminal receiving cavity, a free end of the contact portion is connected with a middle of a bearing portion, the bearing portion is restricted under the positioning portion for preventing the contact portion from flipping upwardly out of the insulating housing.

9. The connector as claimed in claim 5, wherein two opposite sides of the terminal receiving cavity protrude face-to-face to form a pair of locating portions each extending vertically at a lower portion of the terminal receiving cavity, a locating groove is formed between the locating portion and a rear wall of the terminal receiving cavity, two opposite side edges of the base portion oppositely protrude outward to form a pair of fixing portions fixed in the corresponding locating grooves.

10. The connector as claimed in claim 9, wherein a top end of the locating portion extends rearward to connect with the rear wall of the terminal receiving cavity for holding the fixing portion firmly.

* * * * *